United States Patent [19]

Greer

[11] 4,129,017

[45] Dec. 12, 1978

[54] LAB SAMPLE JET DYEING MACHINE

[75] Inventor: James E. Greer, Greensboro, N.C.

[73] Assignee: Burlington Industries, Inc., Greensboro, N.C.

[21] Appl. No.: 763,152

[22] Filed: Jan. 27, 1977

[51] Int. Cl.[2] ..... D06B 3/28

[52] U.S. Cl. ..... 68/15; 68/177; 68/184

[58] Field of Search ..... 68/15, 148, 171, 172, 68/173, 175, 177, 178, 181 R, 184

[56] References Cited

U.S. PATENT DOCUMENTS

| | | | |
|---|---|---|---|
| 943,632 | 12/1909 | Gminder | 68/177 |
| 2,764,009 | 9/1956 | Sarti | 68/15 |
| 2,978,291 | 4/1961 | Fahringer | 68/177 X |
| 3,587,256 | 6/1971 | Spara | 68/177 |
| 3,921,420 | 11/1975 | Aurich et al. | 68/178 X |

FOREIGN PATENT DOCUMENTS

| | | | |
|---|---|---|---|
| 934645 | 11/1955 | Fed. Rep. of Germany | 68/177 |
| 1513008 | 1/1968 | France | 68/177 |

*Primary Examiner*—Philip R. Coe

*Attorney, Agent, or Firm*—Cushman, Darby & Cushman

[57] ABSTRACT

An improved jet dyeing machine incorporating various sizes of interchangeable jets for treating textile material preferably short lengths of full-width textile material in which the position of the jet device used to circulate the textile material through the jet dyeing machine and through the treating liquor held therein is movable with respect to the surface level of the dye liquor contained within the machine. At least a portion of the machine enclosing the jet device is comprised of transparent material so that the area on each side of the jet device is observable and means are provided for exteriorly adjusting the jet device. Thus, it is possible to observe the action of the jet as the position of the jet device is moved with respect to the level of the dye liquor within the machine and as the operating characteristics of the jet device are adjusted.

The outside perimeter of the unit is partitioned or enclosed so it eliminates the need for a separate heat exchanger. These principles are applicable to laboratory models capable of dyeing full width short yardage samples or full width full scale production lots.

20 Claims, 6 Drawing Figures

Fig. 2
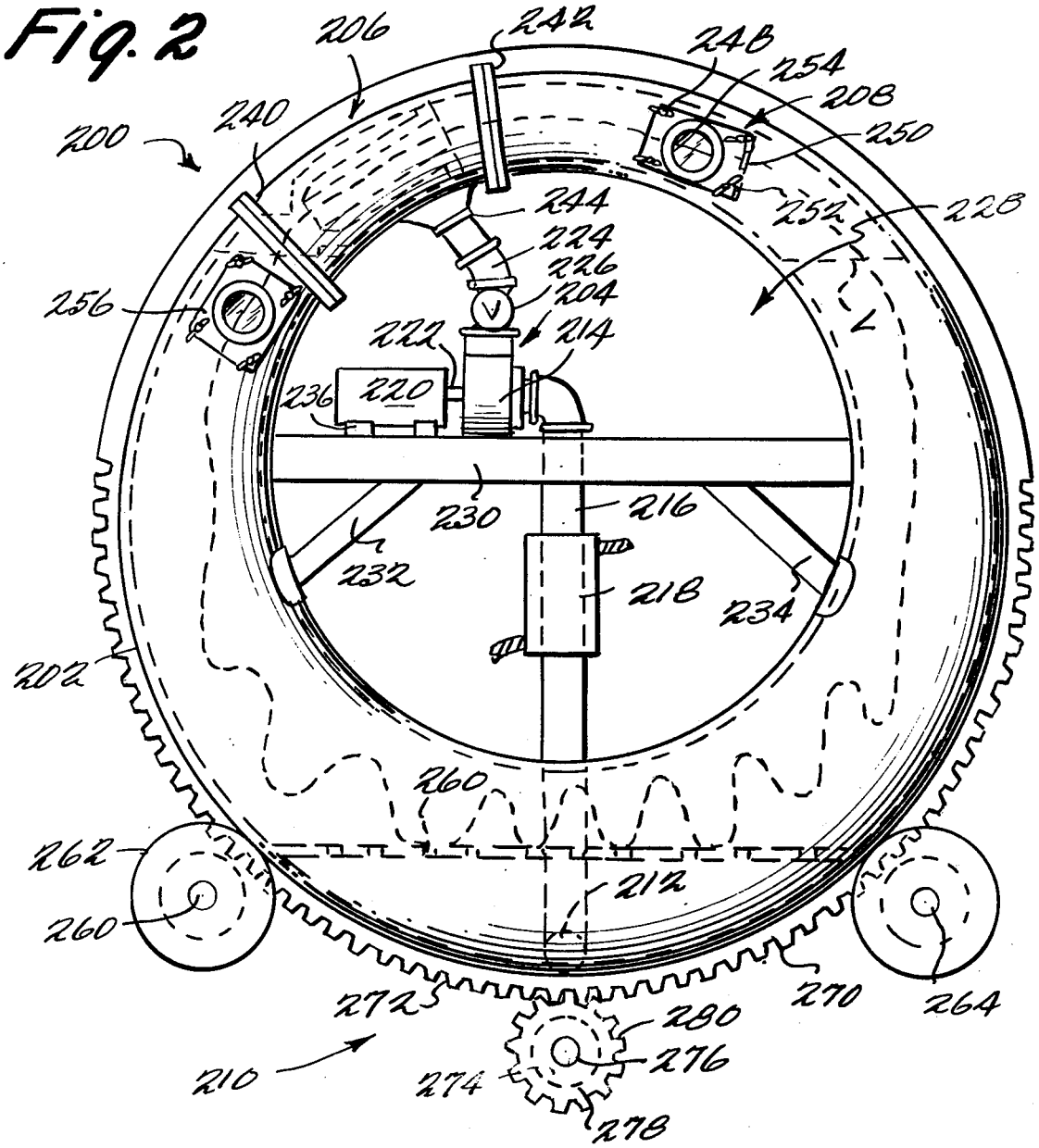
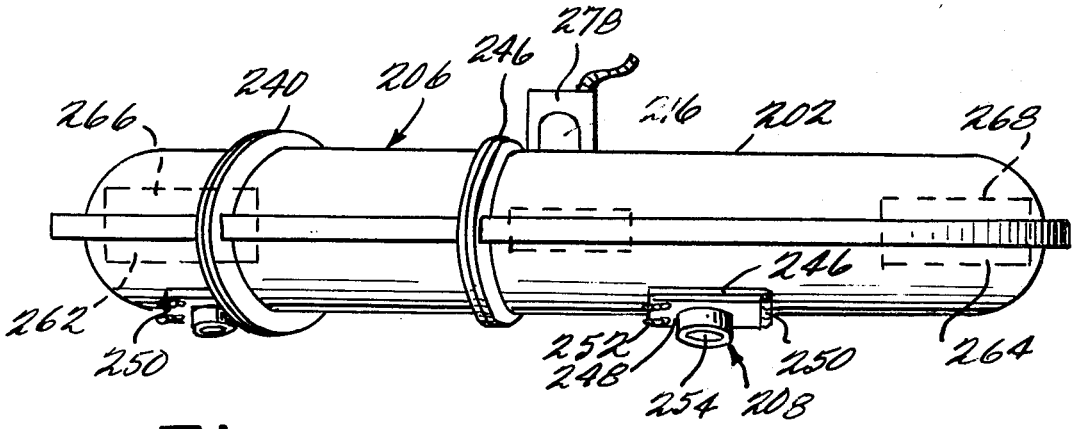
Fig. 3

LAB SAMPLE JET DYEING MACHINE

The present invention relates to an improved jet machine and more specifically to an improved laboratory size jet dyeing machine.

The invention consists of a novel apparatus and method in which the jet portion of the apparatus used for transporting the textile material being treated is itself movable with respect to the level of the treating liquid, most usually a scouring or dye liquor.

In addition, the present invention includes means which allows the fabric entering and exiting the jet device to be observed so that the ballooning and tensioning of the fabric can be seen and observed by an operator while the jet dyeing machine is in operaton. Further, means are also provided for adjusting the gap setting of the jet device even when the jet dyeing machine is closed, pressurized and in operation. Still further, the present invention includes a new and novel arrangement for providing a heat exchanger to heat the treating liquor in that the heat exchanger is formed about the outside wall of the dyeing or treating chamber and thus forms the outside of the jet dyeing machine vessel.

It is well-known that each particular type of fabric, depending upon the weight and fiber type of the fabric, requires processing procedures which are in many instances unique to that fabric. Likewise, processing procedures for each fabric may vary depending on the dyestuff involved. Therefore, prior to dyeing large-scale lots, it was found to be desirable to dye a series of test lots of a particular fabric to determine which among such series exhibited the most efficient particular processing parameters for that fabric. A disadvantage of such prior testing procedures was that a great amount of material was wasted in determining the proper parameters since each test lot required the use of production-size lengths of textile materials usually comprising a number of pieces with each piece being 80–100 yards in length. In addition, such procedures were not suitable since a considerable length of time and effort was required to complete the series of trial dyeings prior to determining the proper parameters for a given type of material.

Previous attempts at developing laboratory-size jet dyeing machines have been made which have allowed the dyeing of smaller quantities of material. These laboratory jet dyeing machines, however, have not provided means by which it is possible to vary the position of the jet portion of the machine with respect to the surface of the dye liquor. Therefore, the ability to perform a wide variety of experiments has been limited.

As one example, the gap setting in the jet device through which recirculating dye liquor is formed into a jet of liquid directed toward the textile material being circulated in the jet dyeing machine was changeable only between dye cycles. This is true for laboratory as well as full-size production jet dyeing machines. Thus, during dyeings, the gap setting remained fixed and could not be adjusted at will while the machine was in operation, especially when the kier was under pressure. Thus to determine the proper gap setting for any particular fabric required a number of complete dye trials with gap adjustments being made by trial and error and only based on the previous experience of the operator. With the present invention, the gap setting through which recirculated dye liquor is formed into a jet directed toward the textile material is adjustable at will even when the jet dyeing machine is operating under pressure.

In addition to being able to predetermine the paramaters required for effecting proper dyeing of production-size lots, it is also desirable to be able to determine how particular dyestuffs, dye liquors or other treating liquors will react with a particular fabric of production width and weight prior to committing production-size lots of fabric to further experimental testing or production dyeing.

Further, not all previously known laboratory jet dyeing machines have been able to effectively dye short-length pieces of production-type full-width textile in rope form. Production fabrics are commonly used in sample lines for customer advertising purposes. When a customer views a sample line of production fabric, the representation made to that customer is that production-size orders can be dyed to the exact shade exhibited by the sample line. Thus, it is desirable not only to be able to convert sample dyeing formulations to production-size formulations, but also to be able to have dyed the sample line in a manner that would allow for a simple conversion from the sample formulae to the production formulae. This of course also applies to the entire dyeing procedure so that in addition to being able to properly adjust the amounts of dyestuffs and chemicals for the desired fabric-to-dyestuff ratio, it is essential also to be able to determine the proper and most efficient operating conditions of dye times, temperature and rates of rise and cool down on sample-size lots of fabric, so that such conditions can be duplicated for use in dyeing production-size lots of fabric on production-size jet dyeing equipment.

The present invention is an improvement upon basic jet dyeing principles first patented by Victor Fahringer in U.S. Pat. No. 2,978,291. In all of the previous jet dyeing machines known to applicant while the specific location of the jet may vary from machine to machine, the location of the jet in each dyeing machine is fixed and immovable. It has now been found, however, that if the jet device within the jet dyeing machine can be moved with respect to the level of the treating liquid, it is possible to conduct a wide variety of experiments when dyeing production fabric weights in sample-size lots of three to fifteen yards in length. Through such experiments problems associated with dyeing procedures can be created, observed, as well as the observation of various corrective measures, allowing the formulation of the most efficient corrective solutions relative to the textile material being dyed and the dye liquor being used.

By being able to vary the position of the jet with respect to the level of the dye liquor within the machine, it is also possible to create or control the amount of foaming and the speed with which the textile material travels through the dye bath and dye vessel. In addition, it is possible to have substantially infinite control over the tensioning of the textile material being dyed. Thus, it is possible to vary the effect the jet device has on the textile material through proper placement of the jet with respect to the surface of the dye liquor.

Thus, it is possible to determine the most efficient dyeing procedures, dyeing cycles and processing parameters which will produce consistently level and uniform shading from one dye lot to the next while dyeing full-width woven or knitted sample fabrics.

The present invention involves mounting the dye vessel so that the dye vessel itself can be moved, either by pivoting or rotating the dye vessel. In each instance, when the dye vessel itself is moved, the dye liquor contained within the jet dyeing machine will remain level so that the position or location of the jet device with respect to surface of the dye liquor will change. The jet itself can be completely submerged in the treating liquid, or it can be positioned so that only various portions of the jet are submerged or entirely unsubmerged.

The invention is further described with reference to the accompanying drawings wherein:

FIG. 2 is a front elevational view of the second embodiment of the present invention;

FIG. 3 is a top plan view of the second embodiment of the invention;

Figure 1:
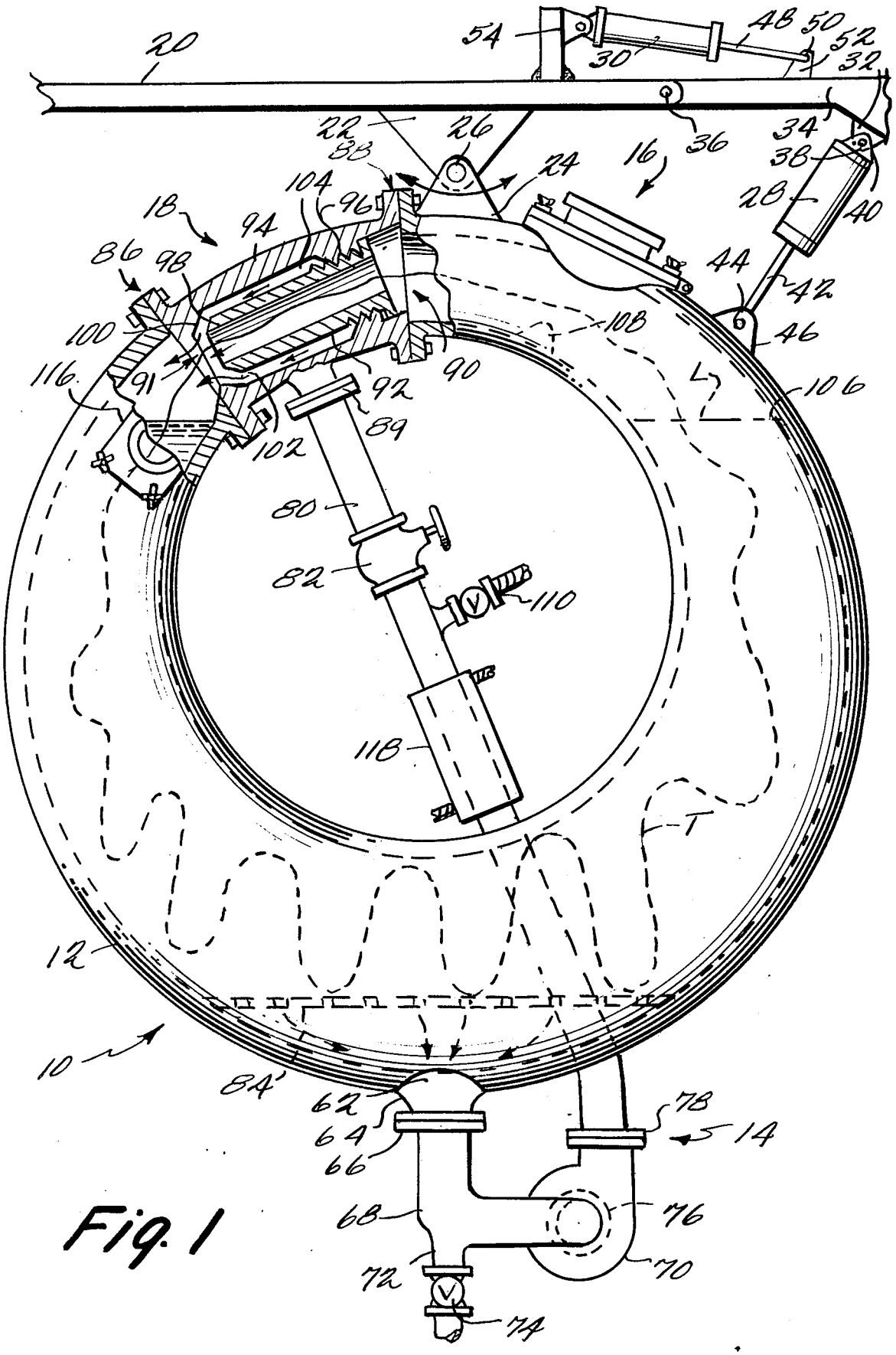
FIG. 1 is a front elevational view of one embodiment of the present invention.

Referring to FIG. 1, the first embodiment of the jet dyeing machine according to the present invention is generally indicated at 10. The jet dyeing machine as shown in FIG. 1 is comprised of a cylindrical pressure vessel or tank 12, a treating liquor circulation assembly 14, a loading and unloading port 16 and a jet assembly 18. The vessel 12 is preferably constructed from stainless steel with the vessel having a diameter in the area adjacent the jet assembly 18 of about 4 inches and a diameter at the bottom portion of about 5 to 7 inches.

The cylindrical pressure vessel 12 is pivotally attached or mounted to a support member generally indicated at 20 by means of brackets 22 and 24 and a pin 26. The bracket 22 is secured as by welding or bolts (not shown) to the support 20 whereas bracket 24 is secured or attached by any convenient means such as welding or bolts (not shown) to the top of vessel 12. Air or hydraulically operated cylinders 28 and 30 of a conventional type are used individually or in tandem to cause the pivoting of the vessel 12 about pin 26. Bracket 32 is secured to arm 34 which is pivotally attached to support 20 as by pin 36. Bracket 38, secured to the end of cylinder 28, serves to mount air cylinder 28 to arm 34 by means of pin 40. The drive shaft 42 of cylinder 28 is connected in turn to vessel 12 by means of pin 44 and bracket 46 which is secured to the upper portion of the sidewall of the vessel 12 as by welding or bolts (not shown). Cylinder 30 has a drive shaft 48 which is secured to pivotal arm 34 by means of pin 50 and bracket 52. Cylinder 30, in turn, is connected to a support 54 by means of brackets 56 and 58 respectively connected to support 54, air cylinder 30 and pin 60.

Located in the bottom of vessel 12, preferably but not necessarily in the center thereof, is a liquid outlet 62 and an outlet conduit 64. A flange connection, indicated generally at 66, serves to connect outlet conduit 64 with return conduit 68 thereby providing communication between outlet 62 and the intake side of pump 70. Also connected to the return conduit 68 is a drain or discharge conduit 72 having a valve 74 placed therein. Drain conduit 72 and valve 74 can be used to control the draining of treating liquid from vessel 12.

Pump 70 is driven by motor 76 which is shown in phantom lines in FIG. 1.

The discharge side of pump 70 is connected by a suitable flange connection, generally indicated at 78, to conduit 80 which serves to communicate the discharge side of pump 70 with jet assembly 18. Since there may be times when it would be desirable to control the quantity of treating liquid flowing from pump 70 to jet assembly 18, a valve 82 is provided in conduit 80. Thus, the nozzle pressure of jet assembly 18 can be controlled or varied by means of adjusting valve 82.

A perforated plate 84 is secured to the interior portion of vessel 12, as by welding, and is spaced from outlet 62 so as to provide sufficient space for treating liquor to be withdrawn from vessel 12 and to keep the textile material T above or away from the outlet 62 so that it is not withdrawn therethrough.

Jet assembly 18 is removably mounted in dye vessel 12, by flange connections 86, 88 and 89. The jet assembly 18 is removably mounted so that different size nozzles can be placed in the jet dyeing machine with nozzle sizes varying from about 50 to about 90 millimeters in diameter and preferably will be 50, 70 and 90 millimeters in diameter. It should be understood however, that depending upon the particular type of fabric being dyed, other nozzle sizes could be incorporated as well.

Jet assembly 18 is comprised of a textile material inlet 90 and outlet 91. An inner pipe member 92 is secured to an outer pipe member 94 as by threads 96. Threads 96 provide means for adjusting the relative position of pipe 92 within pipe 94 and also for adjusting the spacing between the tapered outlet ends 98 of pipe 92 and the tapered outlet ends 100 of pipe 94. Any suitable means for locking the relative position of pipe 92 with respect to pipe 94 can be used such as, for example, a locking nut (not shown). The space between the angled outlet ends 98 and 100 of pipes 92 and 94 respectively forms essentially a venturi or orafice 102. As shown, pipe 92 is spaced inwardly from pipe 92 so that an annular space 104 is formed therebetween. Such an arrangement allows treating liquor flowing through conduit 80 from pump 70 to flow through the annular passageway 104, as shown by the arrows, discharging through the orifice 102 and thereby causing the treating liquid to be formed into a jet which will impinge on the textile material T. As a result, the textile material T will be pulled through the jet assembly from the inlet 90 toward the outlet 91 and through the interior of pipe 92.

The level L of the treating liquor is kept constant by a conventional level sensor 106 which will serve to vary the amount of water added to the vessel 12 during the dyeing process.

In order to aid in smoothing out the passage of the cloth or textile material T through the jet assembly 18 a braking device 108 is provided on the interior surface of vessel 12. Brake 108 is positioned so as to be contacted by textile material T prior to its entry into inlet 90 of jet assembly 18. It should be understood, however, that the location of braking device 108 from the jet inlet 90 can be varied from the position shown in FIG. 1.

Loading port 16 is of a conventional design and is constructed to withstand internal pressures within vessel 12 which can range between about 50 to about 300 psi. Thus, for purposes of this application, further explanation or description of this loading port is felt to be unnecessary.

The loading port 16 can be used to not only load textile material T into vessel 12 but can also be used to fill vessel 12 with treating liquor. Alternatively, treating liquor can be supplied to vessel 12 by means of a flexible conduit 110 attached to conduit 80 by means of any suitable connection.

A sight glass 116 is provided in the sidewall of vessel 12 at a point following the outlet of jet assembly 18. This sight glass 116 allows the operator to observe the effects of assembly 18 on the material being treated as that material exits jet 18.

In addition, a heat exchanger 118 of a conventional design is provided within the treating liquor return line, preferably connected to conduit 80 as shown in FIG. 1 and further discussion relating to such a heat exchanger is not deemed to be necessary. Thus, treating liquor being circulated by pump 70 from outlet 62 to the jet assembly 18 is reheated to a predetermined treating temperature.

In operation, cylinders 28 and 30 either individually or in tandem are actuated, thereby causing the pivoting of vessel 12 about pin 26 so that the position of the outlet end 91 of jet assembly 18 can be varied with respect to the level L of the treating liquor.

When drive shafts 42 and 48 of cylinders 28 and 30, respectively, are fully retracted, vessel 12 will be fully rotated in a counterclockwise direction and the outlet end 91 of jet assembly 18 will be submerged.

When the respective drive shafts 42 and 48 of cylinders 28 and 30 are fully extended, vessel 12 will be fully rotated in a clockwise direction and jet assembly 18 will be rotated to approximately a horizontal position. In such a position both inlet 90 and outlet 91 of jet assembly 18 are above the level L of the treating liquor. The dye vessel 12 is capable of being rotated approximately 30° to 35° in a counterclockwise direction and approximately 30° to 35° in a clockwise direction by means of cylinders 28 and 30.

Turning now to FIG. 2, a second embodiment of the present invention is shown. The jet dyeing machine of the second embodiment is generally referred to at 200. As was the case with the first embodiment, this jet machine is also comprised of a vessel 202, a treating liquid transfer circulation assembly 204, a jet assembly 206, a loading port 208, and a rotating drive assembly generally referred to at 210.

Vessel 202 is preferably a cylindrical pressure vessel or tank, preferably made from stainless steel. The internal diameter of the vessel 202 in its upper portion is approximately 4 inches whereas the internal diameter of the vessel in its lower portion can range from about 5 inches to about 7 inches. While the vessel 202 is preferably of a cylindrical shape, it should be understood that other shapes could perform equally as well, and thus references to the shape and sizes thereof are exemplary and are in no way limiting.

The treating liquid circulation assembly 204 communicates with the interior of vessel 202 by means of outlet 212 located in the lower portion of vessel 202. The inlet side of pump 214 communicates with outlet 212 by means of conduit 216 which is connected to heat exchanger 218 so that treating liquid withdrawn from outlet 212 and delivered to pump 214 will pass through heat exchanger 218 and thus be reheated to a predetermined proper treating temperature. The pump 214 is driven by motor 220 and is connected to pump 214 by means of a drive shaft 222. The outlet side of pump 214 communicates with the jet assembly 206 by means of conduit 224 which has valve 226 placed therein for purposes of controlling the amount of treating liquid supplied to jet assembly 206 and thus provide control for the nozzle pressure of jet assembly 206.

As was the case with the first embodiment, the vessel 202 is constructed preferably from stainless steel, in the form of a doughnut and thus has a hollow interior space generally referred to at 228. A support platform 230 is secured across the interior space 228 by means of welding or any other convenient means. Additional support arms 232 and 234 are also provided and extend between the support platform 230 and the interior end of vessel 202. Support arms 232 and 234 can likewise be secured in place as by welding or any other convenient means. A motor 220 and pump 214 of conventional design are suitably mounted to support platform 230 such as by conventional mounting brackets such as is shown at 236.

Jet assembly 206 is removably mounted to vessel 202 by means of flange joints 240 and 242 and 244. As was the case for the first embodiment, there are different types of textile material. Thus, it is important that the jet assembly 206 be removably mounted so that different jet assemblies can be installed. The jet assembly itself will be similar to the jet assembly referred to above with respect to the first embodiment as shown in FIG. 1. Therefore, further discussion of the jet assembly with regard to this second embodiment is felt to be unnecessary for purposes of a clear description and proper understanding of the present invention.

The loading port 208 is a conventional pressure seal loading port comprised of a mounting base 246 to which a top plate 248 is pivotally attached as by hinge 250 and pivoting toggle bolts 252. Secured to the top plate 248 is a pressureproofed sight glass 254. Thus when toggle bolts 252 are loosened and pivoted out of the way, loading port top plate 248 can be opened and supported by means of hinge 250. Here again, loading port 208 can be used not only to load and unload textile material, but can also be used for purposes of filling vessel 202 with treating liquor.

A second sight glass 256 is provided on the outlet side of jet assembly 206 so that textile material being discharged from jet assembly 206 can be observed. Sight glass 256 can be a fixed sight glass welded in place or alternatively could be a removable sight glass, as is shown in FIG. 2, which is held in place by means of toggle bolts 258.

A perforated plate 260 is also employed in the bottom portion of vessel 202 for purposes of keeping textile material T away from outlet 212 and to allow treating liquid to be removed from the lower portion of vessel 202. Plate 260 is preferably welded into position and subsequently polished so that all burrs which would otherwise snag the textile material are smoothed.

The rotating drive assembly 210 is comprised of support rollers 262, 264 and 266 and 268 which serve to support and allow the vessel 202 to be rotated both in a clockwise and counterclockwise direction. Vessel 202 is provided with an exteriorly extending rim 270 which is provided with gear teeth 272. A drive gear 274 designed to mesh with gear teeth 272 is connected by means of shaft 276 to a motor 278 and is used to rotate the vessel 202. Gear 274 is drivingly connected with gear teeth 272 in the exteriorly extending rim 270 by means of gear teeth 280.

When vessel 202 is rotated counterclockwise approximately 15° from the position as shown in FIG. 2, the outlet of jet assembly 206 will be completely submerged in the treating liquor. If rotation in a counterclockwise direction is continued for about 47° to 50° from the initial vertical position as shown in FIG. 2, both the outlet and inlet sides of the jet assembly 206 will be submerged under the treating level of the liquor.

Rotating vessel 202 in a clockwise direction about 60°, shown in FIG. 2, from the initial vertical position of the vessel 202, will cause the inlet end of the jet assembly 206 to be submerged. Continuing the clockwise rotation of the vessel 202 for approximately 90° or when the return conduit 216 is substantially horizontal, both the inlet and outlet ends of the jet assembly 206 will be submerged in the treating liquid on the right side of the jet machine as viewed in FIG. 2.

Because of the location of outlet 212, it is possible to rotate the jet dyeing machine shonw in FIG. 2 through an arc of about 250° without causing the pump 214 to cavitate due to the removal of outlet 212 form being submerged in the treating liquid. Thus, a full range of jet locations or positions relative to the surface of the liquid within vessel 202 is achievable.

When using 4 and 5 inch diameter pipes for the upper and lower portions respectively of vessel 202, it is possible to treat one pound of four ounce-per-yard material (i.e. a four yard length of production-width textile material) in two and one-half gallons of treating liquor. This results in a treating liquid-to-material ratio of 20:1. Since production width and weights are being treated in the lab sample machines such as for example trial dyeings, it is possible to match treating liquid-to-material ratios used in the sample size jet machine to that of production size jet dyeing machines, and thereafter, convert dyeing formulas form lab sample size dye lots to large-scale production-size dye lots very easily.

While the pressure vessel 202 should be able to withstand 50 to 300 pounds per square inch, in most instances, sufficient pressure is required only to prevent the treating liquid from boiling at operating temperatures above 212° F. Thus, by dyeing short lengths of full-width fabric of woven, knit, or most any other textile material, the samples can be finished in production-size finishing machinery when sewn together. In this way, finished full-width goods are produced which are representative of large-scale production-size lots. In addition, the treating or dyeing formula is easily convertible to a large-scale production-size dye lot since the sample has been dyed and the proper dye liquor-to-cloth ratios and production problems can be more efficiently handled. Further, the present invention provides an improved jet machine in that the position of the jet relative to the treating liquor is variable so that most efficient use is made of the jet for each type of textile material.

Figure 4:
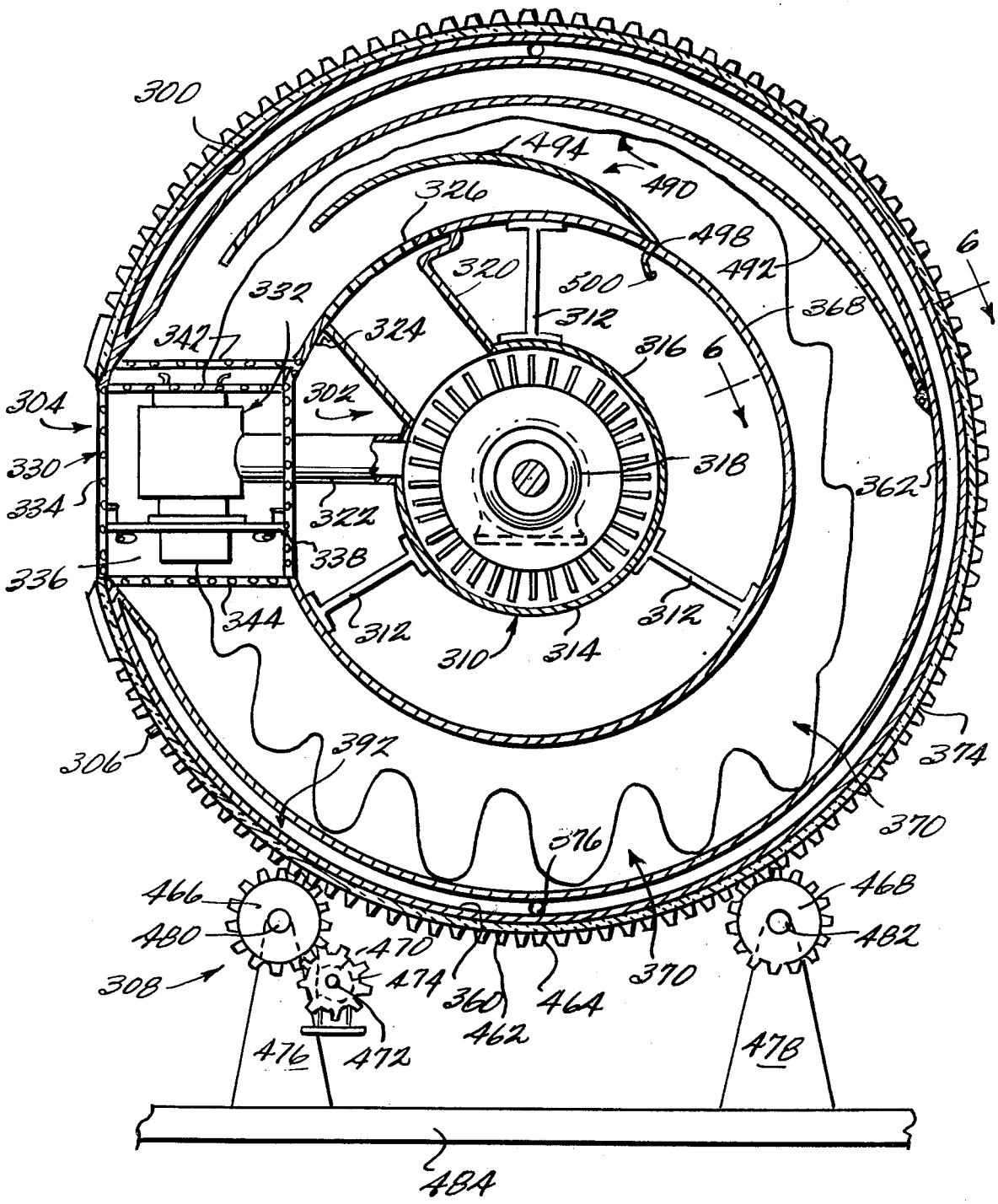
FIG. 4 is a front elevational view, in partial section, of another embodiment of the present invention.

Turning now to FIG. 4, another embodiment of the present invention is shown. As was the case with the embodiments disclosed in FIGS. 1 and 2, this lab sample machine can handle short lengths of full-width production weight fabric and the jet assembly can be moved with respect to the surface level of the treating liquid.

Figure 5:
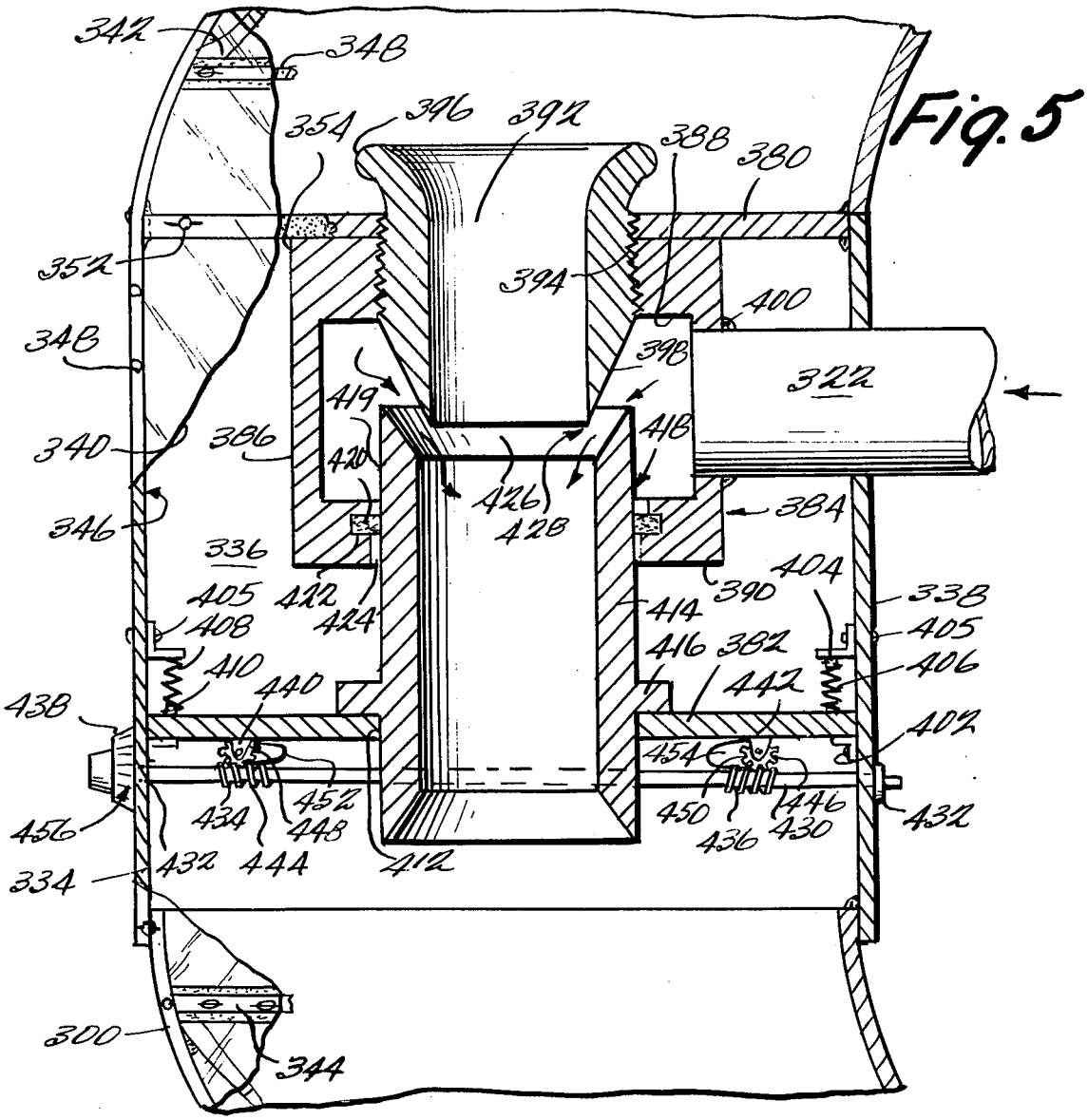
FIG. 5 is an enlarged diagrammatic side elevational view of the jet assembly of the embodiment shown in FIG. 4.
Figure 6:
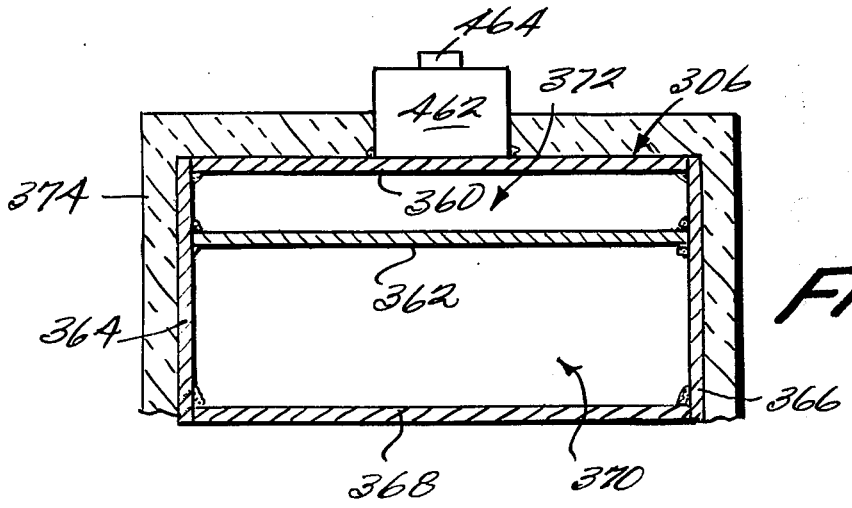
FIG. 6 is a cross-sectional view taken along line 6—6 in FIG. 4.

Referring to FIGS. 4–6 this embodiment is comprised of a closed cylindrical rectangular cross-sectional stainless steel pressure vessel or tank 300, a treating liquor circulation assembly 302, a jet assembly 304, a heat exchange assembly 306, and a vessel drive assembly 308.

The pressure vessel 300 as shown in generally comprised of a closed tube shaped in the form of a hollow doughnut so that the vessel defines a centrally located opening, is preferably constructed from stainless steel with the tube having a substantially rectangular cross section with a width of about 102mm (4 inches) and a depth of about 89mm (3.5 inches). The treating liquid circulation assembly 302 is comprised of a regenerative turbine pump, generally indicated at 310 which is secured interiorly of the vessel 300 as, for example, by support brackets 312. The regenerative pump 310 is comprised of an outer housing 314, welded or otherwise secured to brackets 312 which in turn are welded or otherwise secured to the interior surface of vessel 300. A turbine 316, preferably constructed of stainless steel, is rotatably mounted by conventional means within pump housing 314 and is driven by motor 318. The motor 318 can be, for example, a ½ h.p. variable speed AC motor capable of 1750 rpm, and the turbine can have a nominal diameter of about 137.5mm (5.5 inches). A typical, conventional regenerative pump is manufactured by Aurora Pumps, 800 Airport Road, North Aurora, Illinois, 60512 and is described in Aurora's bulletin 110 C as the one and two stage 110 series turbine-type pumps. A regenerative pump is desirable as it provides the ability to obtain high pressures at medium to low volumes of liquid capacity. It has been found that such a pump produces a greater effective head pressure range such as 20 to 100 feet of head than would a comparable centrifugal pump.

Also centrifugal pumps hold a relatively large volume of liquid, which in this particular application would be dye liquor, and as a result can be the cause of an unbalanced ratio of liquor-to-cloth. By employing a regenerative turbine pump, the volume of liquid held within the pump system can be substantially reduced.

Referring again to FIG. 4, it will be noted that pump 310 is provided with a short intake pipe 320 and an equally short outlet or discharge pipe 322. Preferably both the intake and outlet pipes 320 and 322, respectively, are comprised of stainless steel. Intake pipe 320 is secured to interior wall 368 of pressure vessel 300 by any convenient means such as by welding, shown at 324, and it is likewise secured to the intake side of pump 310. The opening of intake pipe 320 where it meets pressure vessel 300 is covered with a perforated plate 326 to prohibit the entrance of any of the textile material being treated.

Outlet pipe 322 is connected between the outlet side of pump 310 and the jet assembly 304 as will be more fully described hereinafter.

Through use of the regenerative pump 310 and the short inlet and outlet pipes 320 and 322, it is possible to substantially reduce the volume of the dye liquor required for effective operation, thereby allowing for maintenance of proper treating liquor-to-cloth ratios. By maintaining this ratio, it is possible to dye or otherwise treat small yardage lots of production-type fabric under conditions that duplicate fullscale production treatments.

The jet assembly 304 includes an exterior housing, generally indicated at 330, and a venturi jet arrangement, generally indicated at 332.

The exterior housing is preferably a rectangular structure comprised of three solid stainless steel sidewalls 334, 336 and 338 are attached by any suitable means such as by welding to the pressure vessel 300 so that when the jet dyeing machine is operating under high pressure and temperature conditions, leaks will not occur. Of course, other attachment arrangements could be employed so long as leaks did not develop. Sidewalls 334 and 338 together with the portions of the pressure vessel 300 adjacent to jet assembly 304 which are identified as sidewall portions 342 and 344 together define an opening or port in the pressure vessel 300 generally indicated at 346. The exposed edges of sidewalls 334 and 338 together with the exposed portions of the pressure vessel 342 and 344 are provided with a plurality of threaded studs 348. Transparent sidewall 340 is in turn provided with a like number of appertures 350 which correspond to the location and position of threaded studs 348 and can be removably mounted to the pressure vessel 300 by positioning the transparent sidewall 340 over opening 346 and in particular apertures 350 contained therein over the threaded studs 348 and thereafter securing the transparent sidewall 340 in place by means of wing nuts 352. It should be understood that when positioning transparent sidewall 340 onto pressure vessel 300 a suitable sealing gasket 354 would be provided between transparent sidewall 340 and sidewall portions 334, 338 and portions 342 and 344 of the pressure vessel 300 so that when the transparent sidewall was secured in place by wing nuts 352 no leaks will occur when the machine is operating under high pressure and temperature conditions.

The opening or port 346 serves several purposes such as providing means for loading and unloading the pressure vessel 300 while the transparent sidewall 340 permits the operator to observe for example the action of the jet dye bath exhaustion and rates of fabric travel. Also, the effect of changing in the gap settings in the jet device on fabric travel can be likewise readily observed as well as the amount of ballooning in the fabric before and after jet assembly 304. As indicated, the transparent sidewall 346 is removable to allow the operator to change the size of the jet, larger or smaller, to fit the textile material being dyed.

Turning now to FIG. 6, the heat exchange assembly 306 forms the outside of the pressure vessel 300 and is comprised of two concentric sheets of stainless steel 360 and 362, respectively, which are each secured to sidewalls 364 and 366 of the pressure vessel 300. An inner wall 368 forms the interior wall of the main vessel 300 and together with a portion of sidewalls 364 and 366 and sheet 362 forms the main treating chamber 370 of the vessel 300. In a like manner, the remaining portions of sidewalls 364 and 366 together with sheets 360 and 362 form a chamber 372 into which steam will be passed for purposes of heating dye liquor contained within the main treating chamber 370.

Since the heat exchanger assembly 306 forms the exterior of the machine a layer of insulation 374 is preferably placed about the exterior of the vessel 300 as shown in FIG. 6 so that the operator is protected and to retain as much heat as possible within the vessel 300.

Steam is introduced into chamber 372 through a suitable steam inlet 376 and as was previously indicated treating liquor is withdrawn from the main treating chamber 370 of the vessel 300 through pump intake pipe 322, which is connected to the interior wall 368 and through perforated plate 340. By constructing the heat exchanger assembly 306 so that it forms the exterior of vessel 300, problems normally associated with conventional tube-type heat exchangers, such as leaks, pinholes, and contamination of the dye liquor as by mixture with the heating medium or by having condensation form which will cause further dilution of the concentration of the dyestuff are effectively eliminated. In most instances, such problems are not readily detectable until many dyeings have been ruined or damaged to the extent that reworking in same manner is required.

As has been previously mentioned, the liquor-to-cloth ratio in any sample dyeing machine, in order to be useful in preparing production-size dye formulas, must be the same from a proportional standpoint as that which will be used in the production dyeing equipment. By constructing the heat exchanger in the above fashion, it is quite simple to maintain the desired proportional liquor-to-cloth ratio since extra liquid to fill a conventional heat exchanger is not required.

An alternative method (not shown) for constructing a heat exchanger suitable for this type of jet dyeing machine would be to wrap a plurality of strands of tubing around the outside wall of the dyeing machine, in close contact therewith and to pass steam of some other convenient heating medium through this tubing and thereby achieve substantially the same effect as with the heat exchanger assembly 306.

The jet device employed within the jet arrangement 332 is similar to the jet arrangement previously described in this application in the other embodiments. Specifically, referring to FIG. 5, the jet arrangement 332 is supported within pressure vessel 300 by support members 380 and 382 which extend across pressure vessel 300. Support member 380 is secured as by welding 381 to the vessel 300 while support member 382 is vertically movable as will be more fully described hereinafter. Attached to the support member 380 is a jacket member generally indicated at 384 which is comprised of a cylindrical or tube sidewall portion 386 and endwalls 388 and 390.

An upper nozzle portion 392 extends through support member 380 and endwall 388 of the jacket member 384 and is secured thereto by threads 394. The upper nozzle portion 392 is provided with a flared outer lip 396 to aid in directing the textile material into the jet assembly 304. In addition, upper nozzle portion 392 is provided with a tapered inner end 398 which extends into the jacket member 384 so as to extend past endwall 388. The outlet pipe 322 from the pump 310 is secured in the sidewall portion 386 of the jacket member 384 by any convenient means such as welding shown at 400.

As was indicated above, support member 382 is movable vertically and is supported by means of support brackets 402 which are welded or otherwise fixed to sidewalls 334, 336 and 338. In addition, another set of brackets 404 are secured above support plate 382 to sidewalls 334, 336 and 338 by any convenient means such as by rivets 405. Compression springs 406 are provided between bracket members 404 and the upper surface of support member 382 so as to maintain appropriate downward pressure on support member 382. Springs 406 are retained in place by means of studs 408 and 410 which are provided respectively on the bottom side of brackets 404 and the upper surface of support member 382.

The support member 382 is provided with a central opening 412 through which lower nozzle portion 414 extends. The lower nozzle portion 414 is supported in support member 382 by means of a supporting collar 416 which forms an integral part of the sidewall structure of the lower nozzle portion 414. Bottom wall 390 of jacket member 384 is also provided with an opening 418 through which the upper part of the lower nozzle portion 414 extends. In order to provide a sliding seal between the sidewall 419 of the lower nozzle portion 414 and that portion of bottom wall 390 defining opening 418, a ring washer 422 is provided within opening 418 along with upper and lower gaskets 420 and 424. Sidewall 419 is in sliding contact with washer 422 and gaskets 420 and 424 to effect a sliding seal so that lower nozzle portion 414 can be moved vertically toward and away from the tapered inner end 398 of upper nozzle portion 392.

Movement of the lower nozzle portion 414 is effected by a lift mechanism which is provided on both sides of lower nozzle portion 414 and in contact with the bottom surface of support member 382. For clarity purposes, only one of these lift mechanisms is shown in FIG. 5. Each lift mechanism is comprised of a rod 430 which extends transversely between sidewalls 334 and 338 and is rotatably secured and sealed therein by means of bearing members 432. At two intervals on either side of the lower nozzle 414, rod 430 is provided with worm gears 434 and 436. At the front of the device the rod 430 is provided with an indexing dial 438 so that the rods 430 can be indexed or turned in a like manner. Support brackets 440 and 442 are secured to the bottom surface of support member 382 and respectively provide support for pins 444 and 446. Secured to pins 444 and 446 respectively are pinion gears 448 and 450 and eccentrics 452 and 454. Thus, as the dial 438 is turned thereby causing the rod 430 to rotate within bearings 432, worm gears 434 and 436 contact pinions 448 and 450 and thereby cause eccentrics 452 and 454 to be rotated so as to raise or lower support member 382 depending upon the way dial 438 is turned. Dial 438 can also be provided with a scale 456 so that very small incremental adjustments can be made with respect to the positioning of lower nozzle portion 414 with respect to upper nozzle portion 392. By raising and lowering the lower nozzle portion 414, the gap formed between surfaces 426 and 398 can be enlarged or made smaller and thereby vary the size of the orifice through which dye liquor which is pumped so as to impinge upon textile material passing through the jet assembly 304.

As was mentioned previously, pump 310 is capable of generating head pressures of from about 20 to about 100 feet or more with the exact amount of head pressure being determined by the size of the orifice or gap 428 defined by tapered surfaces 398 and 426.

As was discussed with respect to the embodiment shown in FIG. 2, this embodiment shown in FIG. 4 is likewise provided with a drive assembly 308 located around the exterior of vessel 300. The drive assembly 308 can be comprised of a rack formed along the exterior of the vessel 300 as shown generally at 460 and which is comprised of a base member 462 welded to sheet or wall 360 and teeth 464. Teeth 464 are engaged by a plurality of drive gears such as 466 and 468. Drive means 308 also includes a drive motor 470 which is connected by means of its drive shaft 472 to a main drive gear 474 which drivingly engages drive gear 466. Drive gears 466 and 468 are respectively mounted on mounting brackets 476 and 478 by shafts 480 and 482, with brackets 476 and 478 being suitably supported such as by pad 484.

Thus, clockwise or counterclockwise rotation of vessel 300 makes it possible to change the location of jet assembly 304 with respect to the surface level of treating liquid located within the main treating chamber 370. By being able to change the position of the jet with respect to the liquor level, it is possible for the fabric to be allowed to enter the jet with little or no drag or friction or with extremely high drag or friction, depending upon whether the jet is submerged or unsubmerged.

As was indicated previously with respect to the other embodiments, a liquid level controller can be used but is not deemed to be necessary. The operator has the choice of either filling the machine completely so that there is no air space located at the top of the machine or the machine can be only partially filled. As the vessel becomes more and morefilled, the weightlessness of the cloth increases and thus the drag or distortion of the cloth against the sidewalls of the inner main treating chamber 370 is lessened. When fabric becomes weightless, it is more easily moved by the effects of the jet and the circulating treating liquid in the treating chamber 370. If fragile or lightweight goods are being dyed the amount of distortion is lessened as the chamber 370 approaches the point at which it is completely filled.

As was also discussed previously a braking device such as shown at 490 can be installed within the chamber 370 prior to the point at which the cloth enters nozzle 392.

The brake 490 is comprised of two braking sheets 492 and 494 which direct the path or flow of the cloth toward the jet assembly 304. The braking sheet 492 is preferably comprised of a teflon coated steel or stainless steel sheet which is suitably attached to the interior surface of plate 362 which forms one wall of the main processing chamber 370. The brake sheet 494 is also preferably comprised of a teflon coated steel plate which can either be rigidly secured to the interior surface 368 of main chamber 370 near what is normally considered to be the top of the treating chamber 370. The brake sheet 494 could, however, be secured to a shaft 496 which extends through the wall member 368 and specifically through a sealing bearing 498 with the other end of shaft 496 being attached to a handle 500. By suitable operation of the handle 500 the operator can alter the position of braking sheet 494 to allow some flexibility for the operator to modify the extent to which the cloth is restrained by means of braking sheets 492 and 494. The braking sheets 492 and 494 are provided to smooth out the passage of the cloth of textile material through the jet assembly 304 and while they are shown in FIG. 4 as being positioned in the upper portions of main treating chamber 370 it should be understood that the specific location of the braking device 490 can be varied and still provide a braking effect described above. Likewise, other forms and modifications of the braking device could equally well be used.

The volume of treating liquid or dye liquor required to fill the dyeing machine shown in FIG. 4 could be within the range of about 10 liters to 15 liters or about 2½ to 4 gallons. This would be sufficient liquid to maintain a liquor-to-cloth ratio ranging between about 5:1 to 39:1 with the preferred liquor-to-cloth ratio being 20:1. Such a range of liquor-to-cloth ratios would be comparable to the liquor-to-cloth duplicatable in full-size production jet dyeing machines that would be used to dye full-width production-size pieces of textile material which would range in length from about 100 to 300 meters. The applicant is of the belief that the cloth, if heat set prior to being dyed, can be dyed in an excellent condition essentially free of cracks, streaks and blotches and can be dyed quickly with uniform and level colors. However, in that regard knitted goods often need not be heat set prior to dyeing while woven goods generally are pre-heat set prior to dyeing.

Exemplary of the type of sample-size dye lot contemplated for treatment in the present invention as described hereinbefore, would be a full-width production-type fabric which might weigh approximately 500 grams and which would be treated in approximately 10 liters of treating liquid, thereby producing a liquor-to-cloth ratio of 20:1. Such a piece of cloth would range between 5 to 6 meters in length and since the textile fabric contemplated would be full-width, a plurality of dyed samples could be subsequently sewn together with any further finishing being readily accomplished on full-width production finishing equipment. Likewise, the fabric could be a truly representative sample of what could be obtained in large-scale production-size dye lots, ranging from 100 to 4,000 meters in length, since the liquor-to-cloth ratio is in the sample dyeing, is consistent with the liquor-to-cloth ratio in production dyeing. These liquor-to-cloth ratios make it possible to convert the sample dyeing formulas to formulas suitable for large-scale production-size dye lots thereby assuring a greater degree of dyeing repeatability from the sample lots to production lots.

It will now be clear that there is provided a device which accomplishes the objectives heretofore referred to. While the invention has been disclosed in its preferred form, it is to be understood that the specific embodiments thereof as described and illustrated herein, are not to be considered in a limiting sense as there may be other forms or modifications of the invention which should also be construed to come within the scope of the appended claims.

What is claimed is:

1. A machine for treating textile material in generally rope form with a treating liquid comprising: means defining a closed vessel providing an endless path for circulation of a length of the textile material about a generally horizontal axis through the treating liquid in said vessel; means in said path for forming a generally annular converging jet of liquid surrounding the textile material for at least assisting in circulating the textile material in said path, said jet forming means attached to said vessel; means for withdrawing treating liquid from said vessel means and supplying the liquid under pressure to said jet forming means; and means for mounting said vessel for rotation about said horizontal axis so that the position of said jet forming means is movable along said path.

2. A machine as in claim 1 wherein said jet means includes an orifice and jet adjusting means for adjusting the orifice so as to vary the formation of the generally annular converging jet of liquid.

3. A machine as in claim 1 wherein said means for withdrawing treating liquid includes heat exchanger means for heating the withdrawn treating liquid to a predetermined temperature.

4. A machine as in claim 1 wherein said means for mounting said vessel means for movement about a generally horizontal axis includes rack means positioned about at least a portion of the exterior of said vessel means, support means engaging said rack means for supporting said vessel means and rotating said vessel means.

5. A machine as in claim 1 wherein said vessel means is comprised of first and second chambers having a common wall therebetween, said first chamber forming the main treating chamber for holding the treating liquid and the path for the textile material, said second chamber forming a heat exchanger for establishing and maintaining predetermined operating temperatures for treating liquid contained in said first chamber.

6. A machine as in claim 5 wherein said second chamber forms the exterior of said vessel.

7. A machine as in claim 1 wherein said vessel means further includes means for observing the textile material at the entrance of said jet forming means.

8. A machine as in claim 1 wherein said vessel means further includes means for observing the textile material at the point of discharge from said jet means.

9. A machine as in claim 1 wherein said machine further includes brake means located within said vessel means upstream from said jet means.

10. A machine as in claim 1 wherein said means for withdrawing treating liquid includes a regenerative turbine pump.

11. A machine as in claim 10 further including inlet and outlet pipes extending between said pump and said vessel having a predetermined size so that the liquor-to-cloth ratio can vary from about 5:1 to about 39:1.

12. A machine as in claim 1 wherein said vessel is rotatable between a first position where said jet forming means is located at the top dead center of said path and a second position where said jet forming means is located 90 degrees away from said first position.

13. A machine as in claim 1 wherein said vessel is rotatable between a first position where said jet forming means is located midway between the top dead center and the bottom of said path on one side of said vessel and a second position where said jet forming means is located in a position substantially opposite said first position.

14. A machine as in claim 1 wherein said vessel is comprised of a closed tube shaped in the form of a donut thereby defining a central opening; said liquid withdrawing and supplying means being mounted within said central opening.

15. In a jet dyeing machine for treating textile material in generally rope form with a treating liquid which includes means defining a closed vessel providing an endless path for circulation of a length of the textile material through treating liquid held in said vessel; means in said path for forming a jet-like flow of the treating liquid and for directing such liquid flow against the textile material so that such flow at least assists in circulating the textile material around said path; means for withdrawing treating liquid from said vessel means and supplying treating liquid under pressure to said means for forming said jet-like flow wherein the improvement comprises an adjustable means for forming the jet-like flow of treating liquid including a hollow jacket member secured to said machine and having top, bottom and sidewalls each of which is provided with means defining an opening extending therethrough in at least a portion of their respective wall areas; first and second nozzle assemblies, said first nozzle assembly extending within said jacket member and being removably secured within the opening in the top wall of said jacket member; said second nozzle assembly extending within said jacket member and being slidably retained within the opening in the bottom wall of said jacket member, so that said first and second nozzles are aligned and spaced from one another with the portions extending into said jacket member having inwardly and downwardly tapered inner ends, defining an orifice therebetween and wherein said flow means is connected to the opening in said sidewall so that treating liquid will flow through said jacket member, and moving means for incrementally moving said second nozzle assembly with respect to said first nozzle assembly so as to define a variable orifice therebetween through which treating liquid is directed toward the textile material.

16. An improved jet dyeing machine as in claim 15 wherein said first nozzle assembly includes a nozzle support wall secured to said vessel, said jacket member being secured to said nozzle support wall, means defining an opening extending through said support wall aligned with the opening in the top wall of said jacket member, a first nozzle portion positioned so as to extend through the opening in said nozzle support wall and secured therein, said first nozzle portion being a hollow cylinder-shaped member having a receiving end and a tapered inner end, said second nozzle assembly including a movable support wall supported by said adjustment means, means defining an opening extending through said movable support wall, a second nozzle portion positioned so as to extend through the opening in said movable nozzle support wall, said second nozzle portion being a hollow cylinder-shaped member having an inwardly tapered receiving end and a discharge end, said inwardly tapered receiving end being positioned about the tapered inner end of said first nozzle portion.

17. An improved jet dyeing machine as in claim 16 wherein said first nozzle portion is adjustably secured within said nozzle support wall.

18. An improved jet dyeing machine as in claim 16 wherein said jacket means is fixedly attached to said nozzle support wall and about the opening therein, said jacket means slidably receiving said second nozzle portion therein so that said first and second nozzle portions are directly opposite one another, said jacket means including sliding seal means for providing a liquid-tight seal between said jacket means and said second nozzle means.

19. An improved jet dyeing machine as in claim 15 wherein said vessel includes a transparent wall portion adjacent said means for forming said jet-like flow so that the textile material can be viewed as it enters and is discharged therefrom.

20. In a jet dyeing machine for treating textile material in generally rope form with a treating liquid which includes means defining a closed vessel providing an endless path for circulation of a length of the textile material through treating liquid held in said vessel; means in said path for forming a jet-like flow of the treating liquid and for directing such liquid flow against the textile material so that such flow at least assists in circulating the textile material around said path; means for withdrawing treating liquid from said vessel means and supplying treating liquid under pressure to said means for forming said jet-like flow wherein the improvement comprises having said jet forming means comprised of a hollow jacket member; a first nozzle assembly removably secured in one side of the hollow jacket member; a second nozzle assembly slidably secured in the opposite side of said hollow jacket member; said first and second nozzle assemblies each having portions thereof extending into said hollow jacket assembly with each having inwardly and downwardly tapered inner ends which are spaced from one another so as to define an orifice therebetween and means for incrementally moving said second nozzle assembly for incrementally varying the size of the orifice.

* * * * *